US007409815B2

(12) United States Patent
Clough et al.

(10) Patent No.: US 7,409,815 B2
(45) **Date of Patent: *Aug. 12, 2008**

(54) WIRE ROPE INCORPORATING FLUOROPOLYMER FIBER

(75) Inventors: Norman Clough, Landenberg, PA (US); Robert Sassa, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/219,484

(22) Filed: Sep. 2, 2005

(65) Prior Publication Data

US 2007/0062174 A1 Mar. 22, 2007

(51) Int. Cl.
*D02G 3/02* (2006.01)
*D02G 3/22* (2006.01)

(52) U.S. Cl. ..... 57/212; 57/238

(58) Field of Classification Search ..... 57/210–216, 57/218–220, 222, 230, 231, 236–239, 244
See application file for complete search history.

(56) References Cited

U.S. PATENT DOCUMENTS

| | | | | |
|---|---|---|---|---|
| 3,758,704 | A | 9/1973 | Naud | 174/102 E |
| 3,844,195 | A | 10/1974 | Rhodes | 87/1 |
| 3,882,667 | A | 5/1975 | Barry | 57/157 |
| 4,375,779 | A | 3/1983 | Fischer | 87/6 |
| 4,624,097 | A | 11/1986 | Wilcox | 57/232 |
| 4,776,851 | A | 10/1988 | Bruchman et al. | 623/13 |
| 4,898,046 | A | 2/1990 | Mancewicz et al. | 74/502 |
| 5,049,155 | A | 9/1991 | Bruchman et al. | 623/17 |
| 5,061,561 | A | 10/1991 | Katayama | 428/364 |
| 5,101,190 | A | 3/1992 | Bullock et al. | 338/214 |
| 5,197,983 | A | 3/1993 | Berman et al. | 623/13 |
| 5,258,040 | A | 11/1993 | Bruchman et al. | 623/66 |
| 5,296,292 | A | 3/1994 | Butters | 428/375 |
| 5,314,446 | A | 5/1994 | Hunter et al. | 606/231 |
| 5,456,983 | A | 10/1995 | Sassa | 428/370 |
| 5,562,987 | A | 10/1996 | Shimizu | 428/364 |
| 5,636,551 | A | 6/1997 | Davidson et al. | 74/502.5 |
| 5,669,214 | A | 9/1997 | Kopanakis | 57/218 |
| 5,692,530 | A | 12/1997 | Bible et al. | 132/321 |
| 5,706,382 | A | 1/1998 | Smith | 385/102 |
| 5,802,828 | A | 9/1998 | Adorno | 57/232 |
| 5,920,671 | A | 7/1999 | Smith | 685/102 |

(Continued)

FOREIGN PATENT DOCUMENTS

| | | | |
|---|---|---|---|
| CA | 1054465 | 5/1979 | 118/36 |

(Continued)

OTHER PUBLICATIONS

M. J. Neale, C8 Frictional properties of materials, Published 1973 Tribology Handbook.

*Primary Examiner*—Shaun R Hurley
(74) *Attorney, Agent, or Firm*—Alan M. Wheatcraft

(57) ABSTRACT

A wire rope including at least one metal wire and at least one fluoropolymer fiber. Preferably, the fluoropolymer fiber is present in an amount less than about 25 weight %, and in alternative embodiments less than 20 weight %, 15 weight %, 10 weight %, and 5 weight %. The fluoropolymer fiber is preferably PTFE, and most preferably expanded polytetrafluoroethylene (ePTFE). The wire rope is useful in tensioned and bending applications.

25 Claims, 4 Drawing Sheets

U.S. PATENT DOCUMENTS

| | | | | |
|---|---|---|---|---|
| 6,010,788 | A | 1/2000 | Kebabjian et al. | 428/381 |
| 6,016,648 | A * | 1/2000 | Bettcher et al. | 57/230 |
| 6,117,547 | A | 9/2000 | Kelmartin, Jr. et al. | 428/364 |
| 6,133,165 | A | 10/2000 | Tamaru et al. | 442/59 |
| 6,167,650 | B1 | 1/2001 | Duback | 43/44.98 |
| 6,418,704 | B2 * | 7/2002 | Bertini et al. | 57/210 |
| 6,424,768 | B1 | 7/2002 | Booth et al. | 385/102 |
| 6,474,057 | B2 * | 11/2002 | Bertini et al. | 57/210 |
| 6,479,143 | B1 | 11/2002 | Tamaru et al. | 428/364 |
| 6,528,709 | B2 | 3/2003 | Hebestreit et al. | 84/297 |
| 6,640,533 | B2 | 11/2003 | Bertini et al. | 57/210 |
| 6,724,282 | B2 | 4/2004 | Kao | 333/243 |
| 2002/0106956 | A1 | 8/2002 | Howland | 442/208 |
| 2003/0196676 | A1 | 10/2003 | Baillle | 132/321 |
| 2003/0226347 | A1 | 12/2003 | Smith et al. | 57/210 |
| 2004/0069132 | A1 | 4/2004 | Kaudsen et al. | |
| 2004/0175567 | A1 | 9/2004 | Huang et al. | 428/393 |
| 2004/0194444 | A1 | 10/2004 | Vinod et al. | |
| 2005/0288775 | A1 * | 12/2005 | Dong | 623/1.54 |
| 2006/0179812 | A1 * | 8/2006 | Clough et al. | 57/210 |
| 2006/0182962 | A1 * | 8/2006 | Bucher et al. | 428/364 |
| 2006/0213175 | A1 * | 9/2006 | Smith et al. | 57/237 |
| 2007/0079695 | A1 * | 4/2007 | Bucher et al. | 87/8 |

FOREIGN PATENT DOCUMENTS

| | | |
|---|---|---|
| WO | WO 03/064760 A2 | 8/2003 |

* cited by examiner

WIRE ROPE INCORPORATING FLUOROPOLYMER FIBER

FIELD OF THE INVENTION

The present invention relates to wire ropes comprising metal wire and fibers and, more particularly, to wire ropes including fluoropolymers fibers such as polytetrafluoroethylene (PTFE).

DEFINITION OF TERMS

As used in this application, the term "wire" means a single metallic threadlike article as indicated at 16 of FIG. 1. A plurality of wires may be combined to form a "strand" 14 as shown in FIG. 1. A plurality of strands may be combined to form a "wire rope" 12 as shown in FIG. 1. Usually, a wire rope consists of multiple strands laid around a fiber or wire core 18. The core serves to maintain the position of the strands during use. The core may be wrapped with fiber or film. As used herein, "fiber" is defined as a non-metallic elongated threadlike article. Strands and wire ropes may contain one or more fibers.

In a common strand construction, six wires 16 are laid around a seventh wire 16, which is referred to as a "six over one construction" 14 of FIG. 2*a*. Multiple six over one constructions can be combined to create a wire rope referred to as a "seven by seven construction" 42 as shown in FIG. 2*a*. Additional alternative rope constructions are contemplated and included in this invention as described herein.

BACKGROUND OF THE INVENTION

Wire ropes are commonly used in high tension and bending stress applications. These applications include control cables (aircraft, automobile, motorcycle, and bicycle), lifting/hoisting/rigging and winching (forestry, defense department, fishing, marine, underground mining, structural, industrial and construction lifting, rigging and winching, oil and gas mining, utilities, elevator, crane, agriculture, aircraft, consumer products, office equipment, sporting goods, fitness equipment), running ropes (tramway, funiculars, ski lift, bridges, ropeways, shuttles), electrical wire or current carrying wires (flexible copper wires/cables (including ribbon cables, printed circuit board conductors), marine and fishing (towing, mooring, slings), navy and us defense department (arrestor cable, underway replenishment cables), reinforcement of rubber and plastics (tires, belts, hoses), and electrical mechanical applications (umbilicals for remote operated vehicles, fiber optic cables, tethers, plow trenches, tow rigs, seismic arrays).

The primary failure mechanisms for wire ropes are abrasion and bending fatigue. Rope life has been extended by altering the design to meet the requirements of the application. For example, the lay of a rope, that is the placement of the wires and strands during construction, can be left or right, regular, lang, or alternate. Furthermore, the strands can be constructed in various combinations of wires and wire sizes to enhance durability. Ropes are also lubricated to extend their service life.

Grease decreases frictional wear and inhibits corrosion. Such lubricants, however, break down over time and require costly and time-consuming replacement. Effective replenishment of lubricant is also a problematic process.

Fibers, such as polypropylene, nylon, polyesters, polyvinyl chloride, and other thermoplastics and thermoset materials and high modulus materials have been added to the rope construction, typically in the core. The fibers have typically been used to carry lubricants in an attempt to increase the abrasion resistance of wire ropes and for corrosion resistance. The use of these fibers to replace metal wire can come at the expense of weakening the rope and have not been put to widespread use because of insufficient durability improvements.

Incorporating pre-formed polymeric inserts into the construction of wire ropes has been proposed to increase rope life and reduce vibration and torsional forces within the rope. These inserts are made to exacting shapes and dimensions and require special care during rope manufacturing. They are relatively complicated and expensive to prepare and are difficult to accurately position in forming the rope.

Wire ropes still suffer from inadequate durability. The object of the present invention is to improve the life of wire ropes.

SUMMARY OF THE INVENTION

The present invention provides a wire rope including at least one metal wire and at least one fluoropolymer fiber. Preferably, the fluoropolymer fiber is present in an amount less than about 25 weight %, and in alternative embodiments less than 20 weight %, 15 weight %, 10 weight %, and 5 weight %. The fluoropolymer fiber is preferably PTFE, and most preferably ePTFE. It is also preferably a non-woven fiber (i.e., not part of a woven fabric). Also preferably, the fluoropolymer fiber is a monofilament. The metal wire is preferably steel or copper. The wire rope may include an additional lubricant, and the fluoropolymer fiber may alternatively include fillers such as carbon, titanium dioxide, or other functional materials. The wire rope may include a sheath around the outside thereof. The wire rope is useful in all of the applications listed above.

In another aspect, the invention provides a method of making a wire rope comprising the steps of providing a metal wire, providing a fluoropolymer fiber, and twisting the metal wire and the fluoropolymer fiber together to form the wire rope. Preferably, the fluoropolymer fiber that is provided has a substantially round cross-section.

In another aspect, the invention provides a method of increasing durability of a wire rope comprising the step of incorporating at least one fluoropolymer fiber into the wire rope.

DETAILED DESCRIPTION OF THE INVENTION

Figure 1:
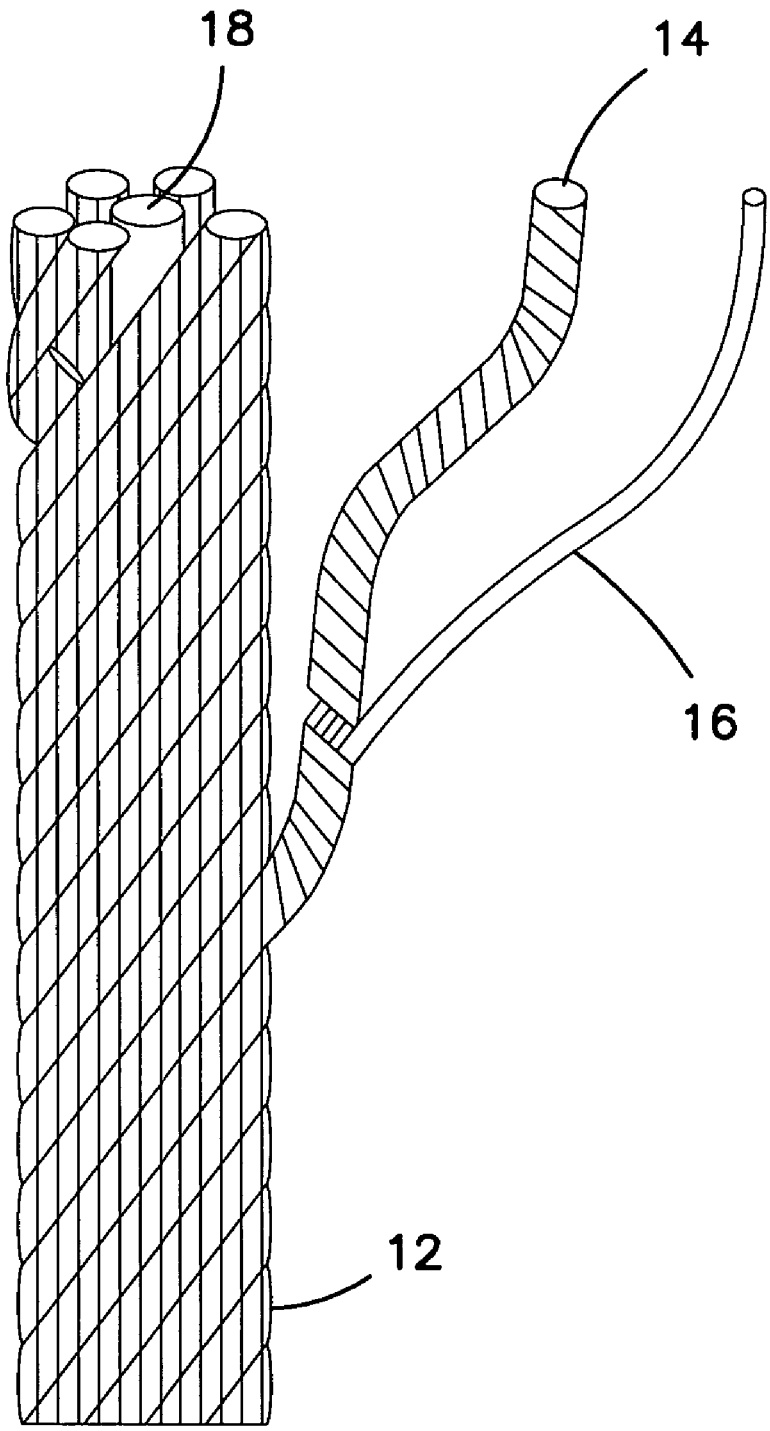
FIG. 1 is an exploded view of an exemplary embodiment of a wire rope.
Figure 2A:
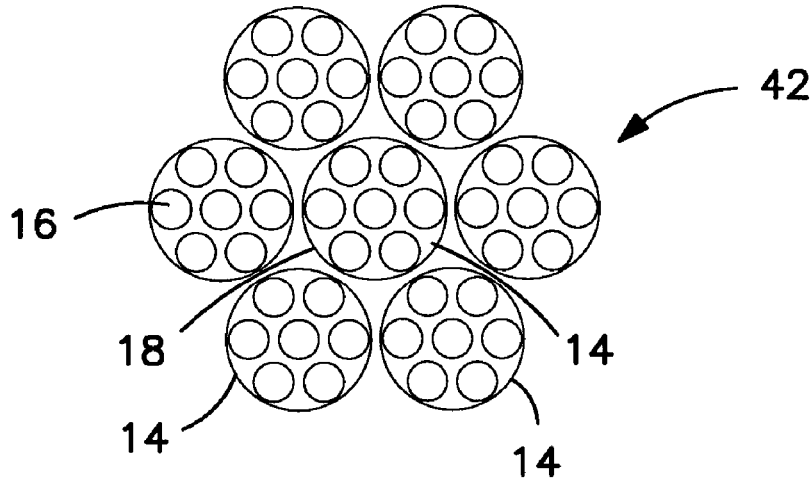
FIG. 2A PRIOR ART
FIG. 2(A) is an exploded view of a prior art wire rope.
Figure 2B:
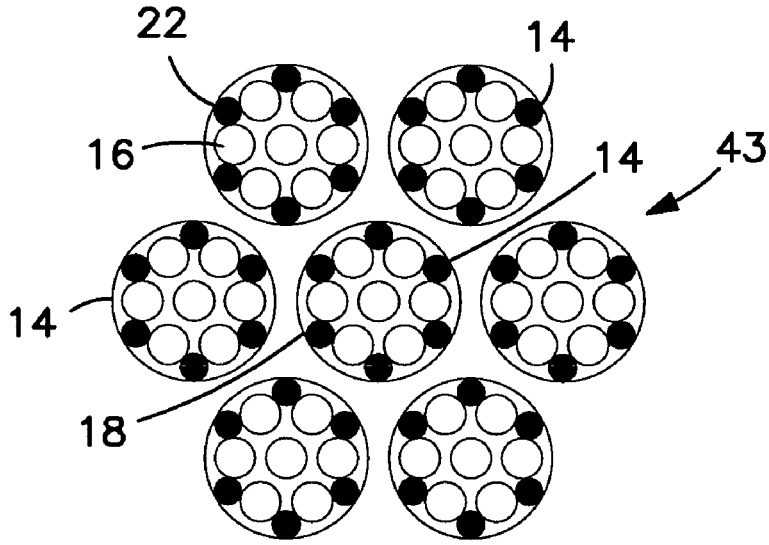
FIG. 2(B) is an exploded view of an exemplary embodiment of a wire rope made according to the present invention.

The present invention is directed to novel wire and fiber constructions for wire strands and wire ropes. With reference to the exemplary embodiment of the present invention represented in FIG. 2(B), a wire rope 43 is illustrated. Fluoropolymer fibers 22 are incorporated among metal wires 16 to form strands 14. In the illustrated embodiment, a strand 14 is used as core 18. Preferably, as shown in FIG. 2(B), all strands 14 include fluoropolymer fibers 22. In alternative embodiments, however, any one or more of strands 14 may include one or more fluoropolymer fibers 22.

Fluoropolymers are the preferred fiber material used in this invention. Certain fluoropolymers, such as expanded PTFE, ETFE, PVDF fibers, and combinations thereof, are most preferred. Other materials that meet the above criteria are also contemplated within the scope of this invention, for example PFA and FEP.

Use of the fluoropolymers of this invention provides unexpected increases in rope life. Certain preferred embodiments of the fibers produced particularly unexpected results. Preferred fibers possess smooth surfaces, without edges. That is, fibers possessing a smooth, round cross-section perform better than similar flat-shaped materials. Rounder shapes are more durable. Fibers with lower porosity (i.e., less void volume) are also preferred. This finding is contrary to the belief that a softer, more conformable, hence, higher porosity fiber would better mitigate the effects of mechanisms that lead to rope failure. The combination of smooth, round cross-sections and low porosity in a fiber is most preferred. Materials having different physical properties than those previously mentioned, but of the same generic material type, are also contemplated within the scope of this invention.

These new ropes perform surprisingly better than prior art ropes in yarn-on-yarn abrasion tests, rotating beam tests, and bend over sheave tests. The dramatic improvement in durability results from novel combinations of fibers and metal wires. As demonstrated in the examples that follow, the added fluoropolymer fibers of this invention increase durability even of wire ropes having conventional lubricants. It is surprising that the addition of fibers provides such a dramatic increase in the life of metal wires.

It should be understood that the scope of the invention is not limited to the addition of a single type of fiber material or only those rope constructions described herein. Whereas steel is the preferred wire material because of its extensive performance history, other metal wires, including but not limited to copper, for example, can be used in practicing the present invention. The present invention may minimize or even eliminate the need for frequent maintenance given the dramatic increase in life seen in durability performance tests.

Another important element of the present invention is the ease in which the fibers can be added during rope construction. The fibers are placed by conventional means, using conventional rope making machines. Unlike attempts to improve wire rope life in the prior art, the fibers can be round in cross-section. Furthermore, they do not need to be placed in the rope by a separate step; they can be incorporated during rope manufacture itself. Consequently, articles of the present invention are much easier to manufacture, a very important feature given that ropes are produced in extremely long lengths.

A preferred method of making a wire rope according to the present invention involves twisting or braiding together metal wire and at least one fluoropolymer fiber to form a strand, and then twisting or braiding together several strands to produce the wire rope. Three to ninety-one wires are preferably used to construct a strand. The twisting or other combination of the metal wire and fluoropolymer fiber may be done according to wire rope manufacturing methods known in the art.

The following examples are intended to illustrate the present invention but not to limit it. The full scope of the invention is defined in the appended claims.

EXAMPLES

In the examples presented below, abrasion resistance and wear life are tested on various wire strands and wire ropes. The results are indicative of the effects seen in wire strands and wire ropes constructed from the bundles of the present invention, as will be appreciated by those skilled in the art.

The wear life is demonstrated by certain examples in which the wire strands and wire ropes (with and without the inventive combination of fluoropolymer fibers) are cycled to failure. The results are reported as cycles to failure. More details of the tests are provided below.

Testing Methods

Mass per Unit Length and Tensile Strength Measurements

The weight per unit length of each individual fiber was determined by weighing a 9 m length sample of the fiber using a Denver Instruments. Inc. Model AA160 analytical balance and multiplying the mass, expressed in grams, by 1000 thereby expressing results in the units of denier. All tensile testing was conducted at ambient temperature on a tensile test machine (Zellweger USTER® TENSORAPID 4, Uster, Switzerland) equipped with pneumatic fiber grips, utilizing a gauge length of 350 mm and a cross-head speed of 330 mm/min. The strain rate, therefore, was 94.3%/min. The break strength of the fiber, which refers to the peak force, was recorded. Three samples were tested and their average break strength was calculated. The average tenacity of the individual fiber sample expressed in g/d was calculated by dividing the average break strength expressed in grams by the denier value of the individual fiber. In the case of testing a wire, strand or rope, the average tenacity of these samples was calculated by dividing the average break strength of the wire, strand, or rope (in units of grams), by the weight per length value of the wire, strand, or rope (expressed in units of denier). The denier value of the wire, strand, or rope can be determined by measuring the mass of the sample or by summing the denier values of the individual components of the sample.

Density Measurement

Fiber density was determined using the following technique. For fibers with essentially round cross sectional profiles, the fiber volume was calculated from the average diameter of a fixed length of fiber and the density was calculated from the fiber volume and mass of the fiber. For essentially rectangular cross sectional profiles, the fiber volume was calculated from the average thickness and width values of a fixed length of fiber and, again, the fiber density was calculated from the fiber volume and mass of the fiber.

For fibers with round cross-sectional profiles, a 2-meter length of fiber was placed on an A&D FR-300 balance and the mass noted in grams (M). The diameter of the fiber sample was then measured at three points along the fiber using an AMES (Waltham, Mass., USA) Model LG3600 thickness gauge, the average diameter calculated and the volume in units of cubic centimeters of the fiber sample was determined (V). For all other cross-sectional profiles, a 2-meter length of fiber was again placed on an A&D FR-300 balance and the mass noted in grams (M). The thickness of the fiber sample was then measured at 3 points along the fiber using an AMES (Waltham, Mass., USA) Model LG3600 thickness gauge. The width of the fiber was also measured at three points along the same fiber sample using an LP-6 Profile Projector available from Ehrenreich Photo Optical Ind. Inc. Garden City, N.Y. Average values of thickness and width were then calculated and the volume of the fiber sample was determined (V) from the product of the average thickness, average width, and length of the sample. The density for all fiber samples was calculated as follows:

fiber sample density (g/cc)=M/V.

Abrasion Resistance Test Method

The abrasion test was adapted from ASTM Standard Test Method for Wet and Dry Yarn-on-Yarn Abrasion Resistance (Designation D 6611-00). This test method applies to the testing of yarns used in the construction of ropes, in particular, in ropes intended for use in marine environments.

Figure 3:
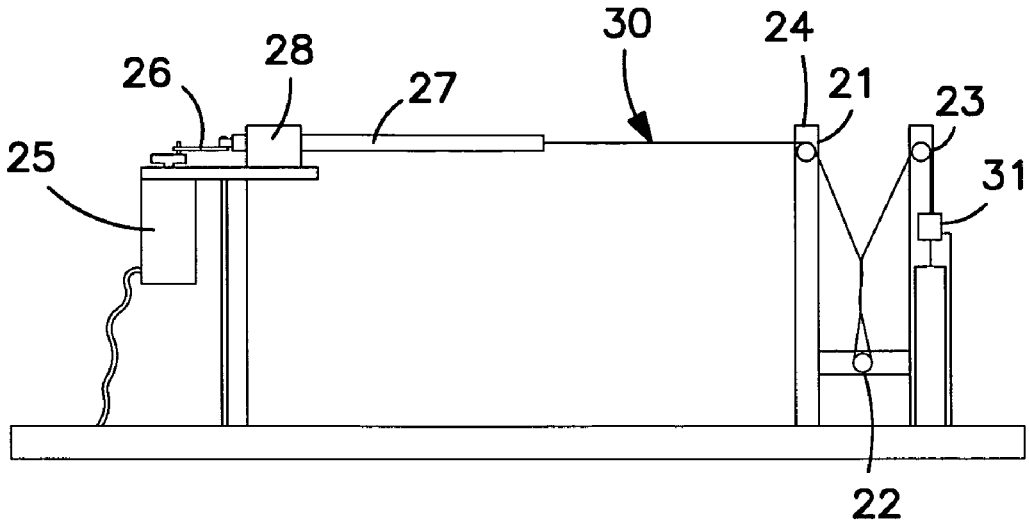
FIG. 3 is an illustration of an abrasion resistance test set-up.
Figure 4:
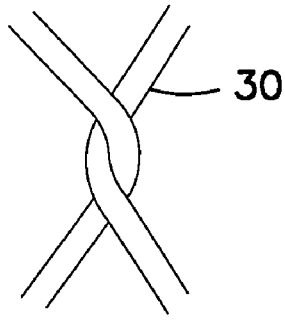
FIG. 4 is an illustration of a twisted wire or fiber as used in the abrasion resistance test.

The test apparatus is shown in FIG. 3 with three pulleys 21, 22, 23 arranged on a vertical frame 24. Pulleys 21 and 23 were 43.2 mm in diameter and pulley 22 was 35.6 mm in diameter. The centerlines of upper pulleys 21, 23 were separated by a distance of 203 mm. The centerline of the lower pulley 22 was 394 mm below a horizontal line connecting the upper pulley 21, 23 centerlines. A motor 25 and crank 26 were positioned as indicated in FIG. 3. An extension rod 27 driven by the motor-driven crank 26 through a bushing 28 was employed to displace the test sample 30 a distance of 50.8 mm as the rod 27 moved forward and back during each cycle. Note that sample 30 includes at least one wire and may include one or more fibers. A cycle comprised a forward and back stroke. A digital counter (not shown) recorded the number of cycles. The crank speed was adjustable to give 96 cycles per minute.

A weight 31 (in the form of a plastic container into which various weights could be added) was tied to one end of sample 30 in order to apply a prescribed tension corresponding to a percentage of the average break strength of the test sample 30. For tests of steel wires the tension corresponded to 5% of the average break strength of the test sample. For tests of steel strands (e.g., six over one constructions) the tension corresponded to 2% of the average break strength of the test sample. For tests of copper wires and copper strands, the tension corresponded to 15% of the average break strength of the test sample. For tests involving the combination of metal wires and fibers, the materials were tensile tested together to determine the break force. The sample 30, while under no tension, was threaded over the third pulley 23, under the second pulley 22, and then over the first pulley 21, in accordance with FIG. 3.

Tension was then applied to the sample 30 by hanging the weight 31 as shown in the figure. The other end of the sample 30 was then affixed to the extension rod 27 attached to the motor crank 26. The rod 27 had previously been positioned to the highest point of the stroke, thereby ensuring that the weight 31 providing the tension was positioned at the maximum height prior to testing. The maximum height was typically 6-8 cm below the centerline of the third pulley 23. Care was taken to ensure that the sample 30 was securely attached to the extension rod 27 and weight 31 in order to prevent slippage during testing.

The test sample 30 while still under tension was then carefully removed from the second, lower, pulley 22. A cylinder (not shown) of approximately 27 mm diameter was placed in the cradle formed by the sample 30 and then turned 360° counterclockwise as viewed from above in order to effect one complete wrap to the sample 30. The cylinder was then carefully removed while the sample 30 was still under tension and the sample 30 was replaced around the second pulley 22.

In tests in which the test sample consisted of at least one wire and at least one fiber, the following additional procedure was followed. After securing the wire(s) as described above and prior to applying any wraps to the wire sample(s), the fiber or fibers were placed in a side by side arrangement with the wire without wrapping. With the wire already placed under tension via attachment to weight 31, the fiber or fibers were also attached to the weight 31. The fiber or fibers were then threaded over the third pulley 23 under the second pulley 22 and then over the first pulley 21. The fiber or fibers were next attached to the motor driven crank under light tension. Unless stated otherwise, the fiber or fibers were always placed closest to the operator. The subsequent procedure for wrapping the fibers was otherwise identical to that outlined above.

Once the test setup was completed, the cycle counter was set to zero, the crank speed was adjusted to the desired speed, and the gear motor was started. The abrasion test continued until the sample completely broke under the tension applied. The number of cycles was noted as the cycles to failure of the sample. In the case that the sample broke outside of the twisted test section, the durability value was reported as greater than the number of cycles at which the sample failed since the test would have otherwise continued.

Fiber Weight Percent

The amount of material added to metal wire was characterized by the fiber weight percent (fiber wt. %). Fiber weight percent was varied by combining different numbers of additional fibers to the metal wire. Fiber weight percent was calculated as the percentage of the weight of fiber material (i.e., the non-metal wire material) to the weight of the fiber and metal wire composite multiplied by 100%.

Rotating Beam Test Method

Figure 5:
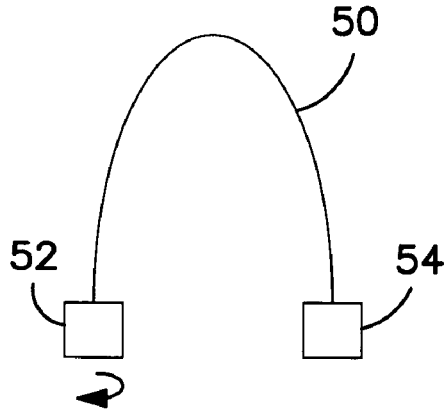
FIG. 5 is an illustration of a rotating beam test set-up.

One end of a wire rope 50 was gripped in the chuck 52 of a rotary power tool (Craftsman model 572.611200, Sears, Roebuck and Co., Hoffman Estates, IL) and the other in a freely idling chuck 54 as indicated in FIG. 5. The rotary tool chuck and the freely idling chuck were positioned to be of the same height and to have parallel axes. The rope was therefore bent into a 180 degree arc. The centerlines of the chucks were positioned 7.1 cm apart and the test length of the rope (i.e., the length of the rope between the chucks) was 11.4 cm. The tool chuck initial rotation speed was within the range of 3000 and 5000 rpm.

The wire rope (and other rope configurations including fiber-containing steel wire ropes) was rotated in this manner until wire failure ensued. Time to failure was recorded. Failure was defined as the rupture of a single fiber of the rope. The cycles to failure was recorded as the product of the rotation rate of the rotary tool chuck and the time to failure.

Bend Over Sheave Test Method

Figure 6:
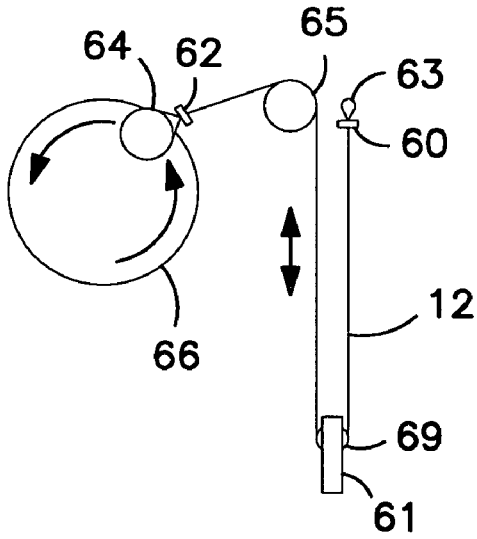
FIG. 6 is an illustration of a bend over sheave test set-up.

Wire rope 60 was mounted in a bend over sheave apparatus as shown in FIG. 6. The ends were made into loops and attached using 1/16 inch (0.159 cm) wire clamps 62. One end was held fixed by a clamp 63 while the other end was attached to a freely rotating brass sheave 64, which in turn was attached to the rotating wheel 66. The rope was threaded over an idler sheave 65. Weights were loaded on a post attached to the test sheave 69. The test sheave was a 0.750 inch (1.9 cm) diameter hardened steel sheave having a 0.084 inch (0.213 cm) diameter grove. Tension was applied by a hanging weight 61 of 108.3 lb (49.1 kg). The test cycle rate was 1 Hz. Failure was defined as by complete breakage of the wire rope allowing the weight to fall. Three specimens were tested, the average number of cycles to failure was recorded.

Porosity

Porosity was expressed in percent porosity and was determined by subtracting the quotient of the average density of the article (described earlier herein) and that of the bulk density of PTFE from 1, then multiplying that value by 100%. For the purposes of this calculation, the bulk density of PTFE was taken to be 2.2 g/cc. The bulk densities of PVDF and ETFE were taken to be 1.8 g/cc and 1.7 g/cc, respectively.

Comparative Example 1

(a) Steel wire possessing a diameter of 0.32 mm, a mass per unit length of 5840 denier, and a break strength of 9.1 kg (Zinc Phos Braiding Wire 35, Techstrand, Lansing, Ill.) was obtained. A length of this wire was folded back onto itself and was twisted one complete wrap, 360°, then tested in accordance with the afore-mentioned abrasion test method. The test result appears in Table 2.

(b) Another length of this wire was twisted together as previously described in Comparative Example 1a in preparation for abrasion testing. In this case, high temperature Lithium grease (Mobilgrease XHP222, Exxon Mobil Corp., Fairfax, Va.) was liberally applied to the exterior surface of the test sample prior to twisting the test sample. The test was performed in the same manner as previously described. The test result appears in Table 2.

Comparative Example 2

Copper wire possessing a diameter of 0.32 mm, a mass per unit length of 6652 denier, and a break strength of 2.0 kg (28AWG SPC wire from Phelps Dodge). A length of this wire was folded back onto itself and was twisted one complete wrap, 360°, then tested in accordance with the afore-mentioned abrasion test method with the exception that the tension corresponded to 15% of the break strength of the test sample. The test result appears in Table 2.

Comparative Example 3

Steel wire possessing a diameter of 0.22 mm, a mass per unit length of 2710 denier, and a break strength of 4.7 kg (Zinc Phos Braiding Wire 35, Techstrand, Lansing, Ill.) was obtained. A six over one right hand lay steel wire strand was made with a pitch of 0.49 cm/revolution using a 0.067 cm diameter ceramic sizing die. A length of this six over one steel wire strand was folded and twisted together and tested in accordance with the afore-mentioned abrasion test method at a tension corresponding to 2% of the average break strength of the test sample. The test result appears in Table 2.

Comparative Example 4

(a) A seven by seven wire rope was made from steel wire (Zinc Phos Braiding Wire 35, Techstrand, Lansing, Ill.). First, a right hand lay six over one strand of Comparative Example 3 was made with the steel wire. This rope was used to construct a left hand lay seven by seven wire rope, with a pitch of 1.55 cm/revolution using a 0.20 cm diameter ceramic sizing die. Three samples of this seven by seven rope were tested in accordance with the rotating beam test method previously described. The average initial rotation speed of the tool chuck was 3367 rpm (range: 3200 to 3700 rpm). The average number of cycles to failure was 45297 cycles. The test results appear in Table 3.

(b) A seven by seven wire rope was made as described above in Comparative Example 4a except that the rope was lubricated with 10W oil (Almo 525, Exxon Mobil Corp., Fairfax, Va. 22037). The seven by seven wire rope was lubricated by soaking it in the oil for 1.5 minutes and then wiping off the excess oil. Four samples were tested in accordance with the rotating beam test method previously described. The average initial rotation speed of the tool chuck was 4650 rpm (range: 4500 to 4900 rpm). The average number of cycles to failure was 94377 cycles. The test results appear in Table 3.

Comparative Example 5

A seven by seven steel wire rope was constructed as described in Example 4a. Three samples of the rope were subjected to bend over sheave testing as previously described. The average number of cycles to failure for the three samples was 2096 cycles. The test results appear in Table 4.

Example 1

(a) Expanded PTFE monofilament fiber (part # V112447, W. L. Gore & Associates, Elkton Md.) was obtained. Properties of this fiber are presented in Table 1. The ePTFE fiber was combined with a single steel wire possessing a diameter of 0.32 mm, a mass per unit length of 5840 denier, and a break strength of 9.1 kg (Zinc Phos Braiding Wire 35, Techstrand, Lansing, Ill.). One of the fibers was combined with one of the wires. Fiber weight percent was determined. The two materials were twisted together and tested in accordance with the afore-mentioned abrasion test method. The test results appear in Table 2.

(b) Example 1(a) was repeated except two fibers were combined with one of the wires. Test results appear in Table 2.

(c) Example 1(a) was repeated except four fibers were combined with one of the wires. Test results appear in Table 2.

(d) Example 1(a) was repeated except six fibers were combined with one of the wires. Test results appear in Table 2.

(e) Another length of steel wire and two lengths of ePTFE fiber of Example 1 a were obtained and tested. In this case, however, high temperature Lithium grease (Mobilgrease XHP222, Exxon Mobil Corp., Fairfax, Va.) was liberally applied to the exterior surface of the test sample prior to twisting the test sample. The test was performed in the same manner as previously described. The test result appears in Table 2.

Example 2

Expanded PTFE monofilament fiber was obtained that possessed the following properties: weight per unit length of 769 denier, tenacity of 2.4 g/d, and diameter of 0.29 mm. Properties of this fiber are presented in Table 1. The ePTFE fiber was combined a single steel wire possessing a diameter of 0.32 mm, a mass per unit length of 5840 denier, and a break strength of 9.1 kg (Zinc Phos Braiding Wire 35, Techstrand, Lansing, Ill.). The two materials were twisted together and tested in accordance with the afore-mentioned abrasion test method. The test results appear in Table 2.

Example 3

(a) Expanded PTFE monofilament fiber (part # V111617, W. L. Gore & Associates, Elkton Md.) was obtained. Properties of this fiber are presented in Table 1. The ePTFE fiber was combined with a single steel wire possessing a diameter of 0.32 mm, a mass per unit length of 5840 denier, and a break strength of 9.1 kg (Zinc Phos Braiding Wire 35, Techstrand, Lansing, Ill.). One of the fibers was combined with one of the wires. Fiber weight percent was determined. The two materials were twisted together and tested in accordance with the afore-mentioned abrasion test method. The test results appear in Table 2.

(b) Example 3(a) was repeated except two fibers were combined with one of the wires. Test results appear in Table 2.

(c) Example 3(a) was repeated except four fibers were combined with one of the wires. Test results appear in Table 2.

(d) Example 3(a) was repeated except six fibers were combined with one of the wires. Test results appear in Table 2.

Example 4

(a) PVDF monofilament fiber (part number 11AIX-915, Albany International, Albany, N.Y.) was obtained. Properties of this fiber are presented in Table 1. The PVDF fiber was combined with a single steel wire possessing a diameter of 0.32 mm, a mass per unit length of 5840 denier, and a break strength of 9.1 kg (Zinc Phos Braiding Wire 35, Techstrand, Lansing, Ill.). One of the fibers was combined with one of the wires. Fiber weight percent was determined. The two materials were twisted together and tested in accordance with the afore-mentioned abrasion test method. The test results appear in Table 2.

(b) Example 4(a) was repeated except two fibers were combined with one of the wires. Test results appear in Table 2.

(c) Example 4(a) was repeated except four fibers were combined with one of the wires. Test results appear in Table 2.

Example 5

(a) Ethylene-tetrafluoroethylene (ETFE) multifilament fluoropolymer fiber (part number HT2216, available from E.I. DuPont deNemours, Inc., Wilmington, Del.) was obtained. Properties of this fiber are presented in Table 1. The ETFE fiber was combined with a single steel wire possessing a diameter of 0.32 mm, a mass per unit length of 5840 denier, and a break strength of 9.1 kg (Zinc Phos Braiding Wire 35, Techstrand, Lansing, Ill.). One of the fibers was combined with one of the wires. Fiber weight percent was determined. The two materials were twisted together and tested in accordance with the afore-mentioned abrasion test method. The test results appear in Table 2.

(b) Example 5(a) was repeated except two fibers were combined with one of the wires. Test results appear in Table 2.

Example 6

Ethylene-tetrafluoroethylene (ETFE) monofilament fluoropolymer fiber (part number 20T3-3PK, Albany International, Albany, N.Y.) was obtained. Properties of this fiber are presented in Table 1. Two of the ETFE fibers were combined with a single steel wire possessing a diameter of 0.32 mm, a mass per unit length of 5840 denier, and a break strength of 9.1 kg (Zinc Phos Braiding Wire 35, Techstrand, Lansing, Ill.). The two materials were twisted together and tested in accordance with the afore-mentioned abrasion test method. The test results appear in Table 2.

Example 7

(a) Matrix-spun PTFE multifilament fiber (part number 6T013. E.I. DuPont deNemours, Inc., Wilmington, Del.) was obtained. Properties of this fiber are presented in Table 1. The matrix-spun PTFE multifilament fiber was combined with a single steel wire possessing a diameter of 0.32 mm, a mass per unit length of 5840 denier, and a break strength of 9.1 kg (Zinc Phos Braiding Wire 35, Techstrand, Lansing, Ill.). One of the fibers was combined with one of the wires. Fiber weight percent was determined. The two materials were twisted together and tested in accordance with the afore-mentioned abrasion test method. The test results appear in Table 2.

(b) Example 7(a) was repeated except two fibers were combined with one of the wires. Test results appear in Table 2.

(c) Example 7(a) was repeated except three fibers were combined with one of the wires. Test results appear in Table 2.

Example 8

(a) Expanded PTFE monofilament fiber of Example 1a was obtained and was combined with a single copper wire possessing a diameter of 0.32 mm, a mass per unit length of 6652 denier, and a break strength of 2.0 kg (28AWG SPC wire from Phelps Dodge). One of the fibers was combined with one of the wires. Fiber weight percent was determined. The two materials were twisted together and tested in accordance with the afore-mentioned abrasion test method with the exception that the tension corresponded to 15% of the break strength of the test sample. The test results appear in Table 2.

(b) Example 8(a) was repeated except two fibers were combined with one of the wires. Test results appear in Table 2.

(c) Example 8(a) was repeated except three fibers were combined with one of the wires. Test results appear in Table 2.

Example 9

Six ePTFE monofilament fibers of Example 1a and 7 steel wires possessing a diameter of 0.22 mm, a mass per unit length of 2710 denier, and a break strength of 4.7 kg (Zinc Phos Braiding Wire 35, Techstrand, Lansing, Ill.) were obtained and combined to form a strand. The strand was made by serving six ePTFE fibers simultaneously with six steel wires over a seventh steel wire. Each ePTFE fiber was served adjacent to a steel wire, resulting is an alternating wire pattern as indicated in strand 14 in FIG. 2*b*. The right hand lay steel wire strand with ePTFE fibers was constructed with a pitch of 0.49 cm/revolution using a 0.08 cm diameter split closing die. The strand construction was twisted together and tested in accordance with the afore-mentioned abrasion test method at a tension corresponding to 2% of the average break strength of the test sample. The test result appears in Table 2.

Example 10

(a) A strand was made from steel wire (Zinc Phos Braiding Wire 35, Techstrand, Lansing, Ill.) and ePTFE monofilament fibers (of Example 1a) as described in Example 9. The properties of the ePTFE fiber are presented in Table 1. This strand was then used to create a seven by seven left hand lay wire rope construction with a pitch of 1.55 cm/revolution, using a 0.22 cm diameter ceramic sizing die.

Three samples were tested in accordance with the rotating beam test method previously described. The average initial rotation speed of the tool chuck was 4300 rpm (range: 3600 to 4900 rpm). The average number of cycles to failure was 62194 cycles. The test results appear in Table 3.

(b) A seven by seven wire rope was made as described above in Example 10a except that the rope was lubricated with 10W air tool oil (Almo 525, Exxon Mobil Corp., Fairfax, Va. 22037). The wire rope was lubricated by soaking it in the oil for 1.5 minutes and then wiping off the excess oil. Three samples were tested in accordance with the rotating beam test method previously described. The average initial rotation speed of the tool chuck was 4667 rpm (range: 4600 to 4700 rpm). The average number of cycles to failure was 117912 cycles. The test results appear in Table 3.

Example 11

A seven by seven wire rope was made from steel wire (Zinc Phos Braiding Wire 35, Techstrand, Lansing, Ill.) and ePTFE monofilament fibers (of Example 1a) as described in Example 10a. The samples of the rope were subjected to bend over sheave testing as previously described. The average number of cycles to failure for the three samples was 3051 cycles. The test results appear in Table 4.

TABLE 3-continued

| Example | metal wire (number of wires) | added material (number of fibers) | number of cycles to failure |
|---|---|---|---|
| Example 10a | stainless steel (49) | ePTFE (42) | 62194 |
| Example 10b | stainless steel (49) | ePTFE (42), 10W oil | 117912 |

TABLE 1

| Example | fiber material | type | mass per unit length (d) | density of fiber (g/cc) | porosity of fiber (%) | tenacity (g/d) |
|---|---|---|---|---|---|---|
| Examples 1, 8-11 | round ePTFE | monofilament | 198 | 2.1 | 5 | 3.6 |
| Example 2 | round ePTFE | monofilament | 769 | 1.2 | 45 | 2.4 |
| Example 3 | flat ePTFE | monofilament | 193 | 1.8 | 18 | 4.1 |
| Example 4 | round PVDF | monofilament | 230 | 1.8 | 0 | 3.1 |
| Example 5 | round ETFE | multifilament | 417 | n/a | n/a | 2.8 |
| Example 6 | round ETFE | monofilament | 435 | 1.7 | 0 | 1.7 |
| Example 7 | round matrix-spun PTFE | multifilament | 407 | n/a | n/a | 1.9 |

TABLE 2

| Example | metal wire type (number of wires) | added material, (number of fibers) | fiber wt. % | cycles to failure |
|---|---|---|---|---|
| Comparative Ex. 1a | stainless steel (1) | none (0) | 0 | 522 |
| Comparative Ex. 1b | stainless steel (1) | Lithium grease (0) | 0 | 18456 |
| Comparative Ex. 2 | copper (1) | none (0) | 0 | 216 |
| Comparative Ex. 3 | stainless steel (7) | none (0) | 0 | 832 |
| Example 1a | stainless steel (1) | ePTFE (1) | 3.3 | 4025 |
| Example 1b | stainless steel (1) | ePTFE (2) | 6.4 | 4689 |
| Example 1c | stainless steel (1) | ePTFE (4) | 11.9 | 18421 |
| Example 1d | stainless steel (1) | ePTFE (6) | 16.9 | 22692 |
| Example 1e | stainless steel (1) | Lithium grease, ePTFE (2) | 6.4 | >25425 |
| Example 2 | stainless steel (1) | ePTFE (1) | 11.6 | 4580 |
| Example 3a | stainless steel (1) | ePTFE (1) | 3.2 | 461 |
| Example 3b | stainless steel (1) | ePTFE (2) | 6.2 | 605 |
| Example 3c | stainless steel (1) | ePTFE (4) | 11.7 | 1250 |
| Example 3d | stainless steel (1) | ePTFE (6) | 16.5 | 2190 |
| Example 4a | stainless steel (1) | PVDF (1) | 3.8 | 1982 |
| Example 4b | stainless steel (1) | PVDF (2) | 7.3 | 7477 |
| Example 4c | stainless steel (1) | PVDF (4) | 13.6 | 28309 |
| Example 5a | stainless steel (1) | ETFE (1) | 6.7 | 742 |
| Example 5b | stainless steel (1) | ETFE (2) | 12.5 | 713 |
| Example 6 | stainless steel (1) | ETFE (2) | 13 | 21312 |
| Example 7a | stainless steel (1) | matrix-spun PTFE (1) | 6.5 | 645 |
| Example 7b | stainless steel (1) | matrix-spun PTFE (2) | 12.2 | 654 |
| Example 7c | stainless steel (1) | matrix-spun PTFE (3) | 17.3 | 1188 |
| Example 8a | copper (1) | ePTFE (1) | 2.9 | 906 |
| Example 8b | copper (1) | ePTFE (2) | 5.6 | 1754 |
| Example 8c | copper (1) | ePTFE (3) | 8.2 | 2634 |
| Example 9 | stainless steel (7) | ePTFE (6) | 5.5 | 56695 |

TABLE 3

| Example | metal wire (number of wires) | added material (number of fibers) | number of cycles to failure |
|---|---|---|---|
| Comparative Ex. 4a | stainless steel (49) | none | 45297 |
| Comparative Ex. 4b | stainless steel (49) | 10W oil | 94377 |

TABLE 4

| Example | metal wire (number of wires) | added material (number of fibers) | number of cycles to failure |
|---|---|---|---|
| Comparative Example 5 | stainless steel (49) | none | 2096 |
| Example 11 | stainless steel (49) | ePTFE (42) | 3051 |

Discussion of Results

The addition of fluoropolymer fibers to metal wire constructions consistently and significantly increased the durability of the inventive strand or wire rope in every durability test that was performed. Three different types of durability tests were utilized to demonstrate the enhanced life of the articles. For each type of fluoropolymer fiber used, over the range of fiber weight percents examined, durability was always higher in constructs containing more fluoropolymer fibers. In all cases, the fiber or fibers were added in a simple manner, laying the fibers against wires in the simplest constructions and feeding the fibers parallel to the wires in more complex constructions involving braiding machines.

Examples 1 through 8 report the results of yarn-on-yarn abrasion resistance testing. Example 1a shows the effects of the simplest combination of ePTFE fiber and steel wire, that is, one fiber and one wire were tested together. The durability was much higher (4025 cycles to failure) than when the same type of steel wire was tested when twisted against itself (522 cycles to failure) as shown in Comparative Example 1a. Durability was even higher when additional fibers were added to the test sample. The cycles to failure was as high as 22,692 when six ePTFE fibers were incorporated (Example 1d). The addition of Lithium grease to the article of Comparative Example 1a extended the life to 18,456 cycles to failure as shown in Comparative Example 1b. Adding the same lubricant in the same manner to the article of Example 1b containing two ePTFE fibers resulted in a durability of greater than 25,425 cycles to failure (as shown in Example 1e). The same improvement in durability was also evident when a different metal wire was used, namely copper wire. The comparison of the results of Example 8 and Comparative Example 2 verify this conclusion. The effect persisted even when articles consisting of larger number of wire strands were tested, as shown in the comparison of Example 9 and Comparative Example 3. In this case, the addition of the ePTFE fibers improved the durability from 832 cycles to failure to 56,695 cycles to failure. (Note that the ePTFE fibers of Examples 8 and 9 are of the same type as used in Example 1.)

The ePTFE fiber of Example 1 was a monofilament possessing a substantially round cross-section. The fiber was also quite dense, having a porosity of only about 5%. A more porous (45%), round cross-section ePTFE monofilament fiber was tested as reported in Example 2. The single fiber in Example 2 dramatically increased the durability (4580 cycles to failure) compared to the steel wire alone reported in Comparative Example 1a (522 cycles to failure). The durability of this inventive fiber construction, however, was significantly less than that reported in Example 1c for very similar fiber weight percent loading using four ePTFE fibers (18,421 cycles to failure).

Two other types of PTFE fiber were examined. One was a flat ePTFE monofilament possessing a porosity of 18%, the other was round matrix-spun PTFE multifilament fiber. The constructions and the yarn-on-yarn test results for these materials appear in Examples 3 and 7, respectively. These fibers, when present in sufficient fiber weight percent, increase the durability of the sample, though not to the extent of the afore-mentioned ePTFE fibers.

Another type of round fluoropolymer monofilament fiber, PVDF, was tested. This fiber was essentially non-porous. The results shown in Example 4 indicate a profound increase in durability (as high as 28,309 cycles to failure, Example 4c) compared to that of steel wire alone (522 cycles to failure; Comparative Example 1a). Two types of ETFE filaments were also examined. The monofilament ETFE fiber of Example 6 performed much better than the multifilament ETFE fiber of Example 5. The two types of ETFE fiber had similar tenacity. Both performed better than steel wire alone.

Example 10 presents the results of rotating beam testing of wire ropes of the present invention. Expanded PTFE fibers of Example 1a were combined with steel wires to create steel ropes. The inventive articles of Example 10a had a durability of 62,194 cycles to failure compared to the wire rope made in essentially the same manner with the same steel wire but containing no fibers (Comparative Example 4a) which had a durability of 45,297 cycles to failure. The articles of Example 10a and Comparative Example 4a were lubricated in the same manner with 10W oil to create the articles of Example 10b and Comparative Example 4b, respectively. Again, the inventive article exhibited much greater durability (117,912 versus 94,377 cycles to failure).

The articles of Example 11 and Comparative Example 5 (which were the same as those described in Example 10a and Comparative Example 4a, respectively) were subjected to bend over sheave testing. Once again, the addition of the ePTFE fibers greatly increased durability (from 2096 to 3051 cycles to failure).

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A wire rope comprising:

(a) a plurality of strands, each said strand comprising at least one metal wire having a mass per unit length greater than 2000 denier; and (b) at least one fluoropolymer fiber comprising expanded PTFE;

(c) wherein said wire rope is a high tension and bending stress application wire rope.

2. A wire rope as defined in claim 1 wherein said fluoropolymer fiber is present in an amount less than about 25 weight %.

3. A wire rope as defined in claim 1 wherein said fluoropolymer fiber is present in an amount less than about 20 weight %.

4. A wire rope as defined in claim 1 wherein said fluoropolymer fiber is present in an amount less than about 15 weight %.

5. A wire rope as defined in claim 1 wherein said fluoropolymer fiber is present in an amount less than about 10 weight %.

6. A wire rope as defined in claim 1 wherein said fluoropolymer fiber is present in an amount less than about 5 weight %.

7. A wire rope as defined in claim 1 wherein said fluoropolymer fiber is a monofilament.

8. A wire rope as defined in claim 1 wherein said fluoropolymer fiber comprises a filler.

9. A wire rope comprising:

(a) a plurality of strands, each said strand comprising at least one stainless steel wire having a mass per unit length greater than 2000 denier;

(b) at least one expanded PTFE fiber;

wherein said expanded PTFE fiber is a monofilament and is present in an amount less than about 10 weight %, and wherein said wire rope is a high tension and bending stress application wire rope.

10. A wire rope as defined in claim 9 further comprising a lubricant.

11. A wire rope as defined in claim 9 wherein said metal wire is steel.

12. A wire rope as defined in claim 9 wherein said metal wire is copper.

13. A wire rope as defined in claim 9 wherein said fluoropolymer fiber is in a strand.

14. A lifting/hoisting/rigging and winching rope comprising the wire rope defined in claim 9.

15. A control cable comprising the wire rope defined in claim 9.

16. An electrical wire comprising the wire rope defined in claim 9.

17. A marine and fishing rope comprising the wire rope defined in claim 9.

18. A reinforcement rope comprising the wire rope defined in claim 9.

19. A structural rope comprising the wire rope defined in claim 12.

20. A running rope comprising the wire rope defined in claim 9.

21. An electrical mechanical cable comprising the wire rope defined in claim 9.

22. A method of making a wire rope comprising:

(a) providing a metal fiber having a mass per unit length greater than 2000 denier;

(b) providing a expanded PTFE fiber; and (c) combining said metal fiber and said expanded PTFE fiber together to form a wire rope, wherein said wire rope is a high tension and bending stress application wire rope.

23. A method of making a wire rope as defined in claim 22 wherein said fluoropolymer fiber has a substantially round cross-section.

24. A method of increasing durability of a wire rope comprising wires having a mass per unit length greater than 2000 denier; and used in a high tension and bending stress application wire rope, the method comprising the step of incorporating at least one expanded PTFE fiber into said wire rope.

25. A method of increasing durability of a wire strand comprising wires having a mass per unit length greater than 2000 denier; and used in a high tension and bending stress application wire rope, the method comprising the step of incorporating at least one expanded PTFE fiber into said wire strand.

* * * * *